United States Patent [19]

Fields

[11] Patent Number: 4,666,224

[45] Date of Patent: May 19, 1987

[54] DEVICE FOR SECURING ELECTRICAL CONNECTORS

[76] Inventor: Thomas J. Fields, 6822 Kenfig Dr., Falls Church, Va. 22042

[21] Appl. No.: 871,837

[22] Filed: Jun. 9, 1986

[51] Int. Cl.[4] ..... H01R 13/44

[52] U.S. Cl. ..... 339/37; 70/57; 339/44 R

[58] Field of Search ..... 339/36, 37, 44 R, 44 M; 174/66, 67; 70/57, 63; 312/215

[56] References Cited

U.S. PATENT DOCUMENTS

| | | | |
|---|---|---|---|
| 2,643,787 | 6/1953 | Rockman | 339/37 X |
| 2,955,272 | 10/1960 | Gallardo | 339/32 R X |
| 3,201,740 | 8/1965 | Rubens | 339/40 |
| 4,081,796 | 3/1978 | Tabron | 174/66 X |
| 4,484,185 | 11/1984 | Graves | 340/656 |
| 4,488,764 | 12/1984 | Pfennig et al. | 339/82 X |
| 4,592,607 | 6/1986 | Pejovic | 339/44 R X |

*Primary Examiner*—Gil Weidenfeld
*Assistant Examiner*—Steven C. Bishop
*Attorney, Agent, or Firm*—Jerry C. Lyell

[57] ABSTRACT

A novel containment device for securing electrical connectors comprising a box fashioned with a slot in one face, a rotatable shelf inside said box and a door or moveable panel on one end of said box. The box is employed by inserting the plug end of an electrical appliance cord through said door and into said box, said plug being placed under said shelf with the cord passing over said shelf and out of the box through said slot. The plug is unable to exit the box due to insufficient clearance between the interior edge of the shelf and the back of the box.

5 Claims, 3 Drawing Figures

FIG. 1
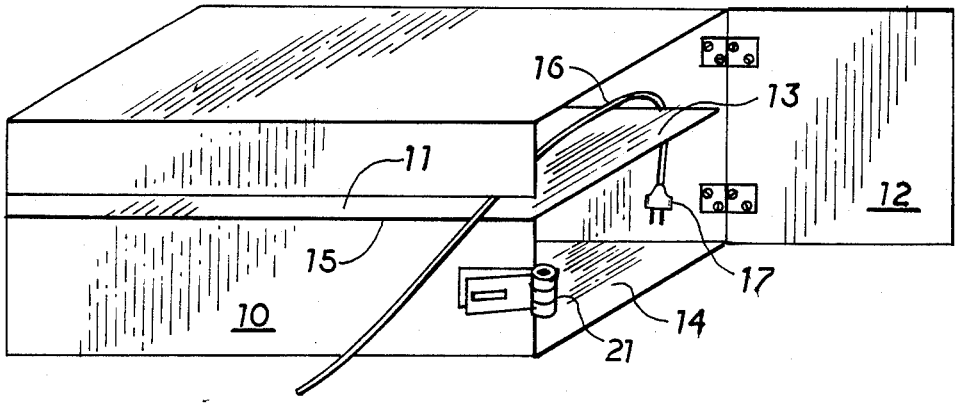
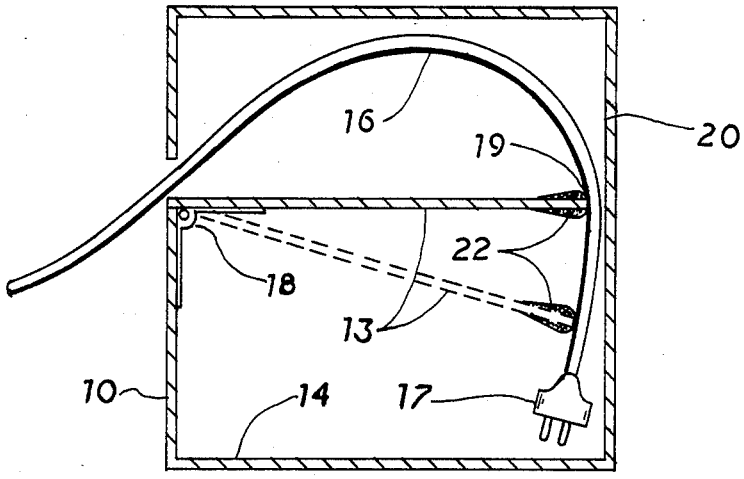
FIG. 2
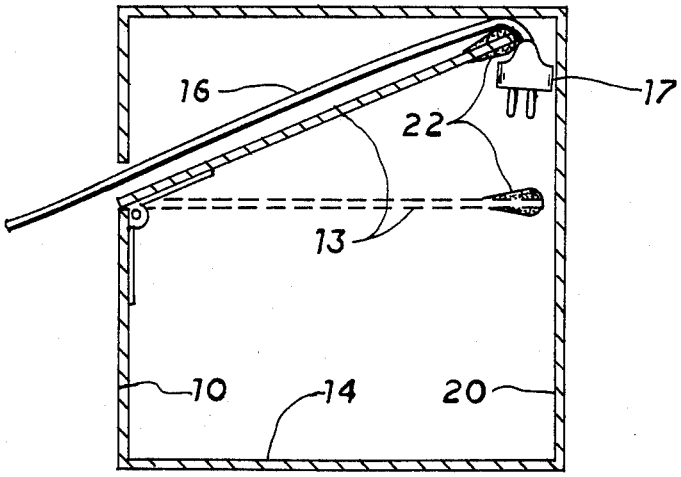
FIG. 3

DEVICE FOR SECURING ELECTRICAL CONNECTORS

BACKGROUND OF THE INVENTION

Most of the electrical safety covers that have been manufactured or invented to date have been designed to prevent the use of a given power outlet and to inhibit the connection between an electric power tool and a given power source. Such safety devices usually employ locks and covers on the power receptacle itself. These features do not, however prevent the activation and use of equipment in other locations where unsecured receptacles may be found.

The present invention, on the other hand, provides a positive locking system which serves to secure the equipment itself against unauthorized use. This invention provides a lockable containment for the plug end of electric power tool cords such that the plugs cannot be deployed nor the tools removed from the vicinity of the box without a key.

SUMMARY OF THE INVENTION

The present invention is a novel containment device or enclosure, the object of which is to secure the plug ends of electric appliance cords against unauthorized or accidental deployment of the plug into electric power source.

The enclosure is a box of novel configuration wherein the particular features consist of a narrow slot running substantially the entire length of one face, one end of said box being hinged so as to open in a direction out and away from one end of said slot, and an interior shelf rotatably hinged or attached along the entire length of one edge of said slot. The various elements of the box are configured such that when the end of the box is open, an electric appliance cord and plug can be placed inside the box by sliding the cord along the interior edge of the shelf. The plug is normally placed under the shelf with the cord passing over the shelf and out of the box through the slot.

The end of the box will normally remain closed except when electric cords are being introduced or removed. The interior shelf is hinged in a manner that permits a narrowly restricted range of motion within the box. The shelf is sized to as to substantially fill or occlude the interior cross section of the box in the plane of the shelf when the shelf is parallel to the bottom of the box. The range of motion of the shelf is thus restricted between the horizontal position and a downwardly inclined angle of approximately 25 degrees.

The declination of the shelf permits electric cords of various diameters to pass between the interior edge of the shelf and the backside of the box (that side opposite the slot). The maximum declination of the shelf does not, however, provide sufficient clearance to permit an electric plug to pass between the interior edge of the shelf and the back of the box. With cords and plugs enclosed in the box, any attempt to withdraw an electric cord results in the cord binding between the interior of the shelf and the back of the box.

In normal use the box can house any desired number of plug ends of cords attached to electric tools and appliances thereby preventing the accidental deployment of a plug into an electric power source. The end of the box that opens can be fitted with locking means in order to make the device childproof or to prevent the unauthorized use of stored tools. In a home workshop or on a construction site where numerous electric tools are normally used, the present invention provides a "positive lock-out" for such tools.

The present invention is particularly suited for use as a security device since the box can be permanently mounted onto walls, work tabls, etc., and can serve as the situs of storage for electric tools within areas that are otherwise open to traffic.

BRIEF DESCRIPTION OF THE DRAWINGS

The invention may be further understood by reference to the drawings in which:

FIG. 1 is an isometric view of the box with the end panel open.

FIG. 2 is a cross section of the box viewed from the end.

FIG. 3 is a cross section of the box viewed from the end showing an alternate embodiment of the invention.

DESCRIPTION OF THE PREFERRED EMBODIMENT

Referring to FIG. 1 of the drawings, the invention is shown to comprise a box, enclosed on all sides except for a slot 11 which runs substantially the entire length of the front face 10. One end of the box comprises a door or panel 12 that is hinged or installed so as to open away from the front face 10. The door or panel 12 can be fitted with hasps 21 or other means such that said door or panel can be closed and locked.

An interior shelf 13 is rotatably attached along the entire length of one edge of said slot. This shelf 13 is sized so as to substantially fill the sectional area of the box in the plane of the shelf when said shelf is parallel to the bottom 14 of the box. The shelf 13 is attached to the lower edge 15 of the slot in a manner that permits a narrow range of motion of said shelf from the horizontal to a shallow declination of approximately 25 degrees.

The above-recited configuration of elements permits the cord 16 and plug 17 of an electric appliance to be secured within the box by sliding the cord along the interior edge of the shelf 13 with the plug 17 tucked underneath said shelf and the cord exiting the box through slot 11. It is a further feature of the invention that slot 11 is sized so as to prohibit the passage of a plug in the event that a plug escapes from underneath shelf 13.

As shown in FIG. 2 the shelf 13 can be attached to the lower edge 15 of the slot 11 by means of hinge 18 fashioned in such a manner as to permit the shelf 13 to rotate to a position no higher than horizontal, and no lower than approximately 25 degrees of declination. Given these last-recited conditions, the clearance between the interior edge 19 of the shelf 13 and the back of the box 20 is intended to be insufficient to permit a plug 17 to pass between the edge of the shelf and the back of the box. The ability of the box to retain electric cords can be enhanced by adding a covering or strip of preformed rubberized material 22 along the interior edge of shelf 13. An attempt to withdraw a cord results in the cord binding between said edging material and the back of the box.

In a slightly different embodiment of the invention, shelf 13 can be permitted to elevate as shown in FIG. 3 such that plug 17 is restrained or bound between the interior edge of the shelf and the top of the box.

It should be noted that the box can be fabricated from a large variety of metallic or non-metallic materials, and that the size of the box and the declination of the shelf and other specific details can be varied as needed in order to achieve the objects of the invention and without regard to any earlier expressed limitations. This invention can be easily adapted for mounting on walls, worktables or other surfaces, thus providing an increased measure of security for stored tools.

What is claimed is:

1. A novel containment device for securing electrical connectors comprising a box wherein the particular features are:

a slot running substantially the entire length of one face or side of said box, one end of said box being hinged so as to open in a direction out and away from one end of said slot, and an interior shelf rotatably hinged or attached along the entire length of one edge of said slot.

2. A novel containment device as recited in claim 1 wherein said interior shelf is sized so as to substantially fill the sectional area of said box in the plane of the shelf when said shelf is parallel to the bottom of said box.

3. A novel containment device as recited in claim 2 wherein the rotation of said interior shelf is permitted to range between a horizontal position and a declination of approximately 25 degrees from horizontal.

4. A novel containment device as recited in claim 2 wherein the rotation of said interior shelf is permitted to range upward sufficiently to come into contact with the top of said box.

5. A novel containment device as recited in claim 3 or claim 4 wherein the interior edge of said interior shelf is covered with preformed rubberized material.

* * * * *